United States Patent [19]

Tang

[11] 4,326,312

[45] Apr. 27, 1982

[54] SINGLE LEG MOORING TERMINAL

[75] Inventor: Phillip H. Tang, Rosemead, Calif.

[73] Assignee: Amtel, Inc., Providence, R.I.

[21] Appl. No.: 34,555

[22] Filed: Apr. 30, 1979

[51] Int. Cl.[3] ..... B63B 21/52; B63B 51/02

[52] U.S. Cl. ..... 441/5; 114/230; 114/257; 405/224; 405/202

[58] Field of Search ..... 9/8 R, 8 P, 8.3 R, 8.3 E; 114/230, 264, 256, 257, 293; 405/195, 224, 202

[56] References Cited

U.S. PATENT DOCUMENTS

| | | | |
|---|---|---|---|
| 3,479,673 | 11/1969 | Manning | 114/230 |
| 3,522,787 | 8/1970 | Tam | 9/8 R |
| 3,590,767 | 7/1971 | Dunbar | 114/230 |
| 3,732,588 | 5/1973 | Mitchell | 9/8 R |
| 3,883,912 | 5/1975 | Pedersen | 9/8 P |
| 3,942,204 | 3/1976 | Gruy | 114/230 |
| 4,031,582 | 6/1977 | Van Heijst | 9/8 P |
| 4,096,704 | 6/1978 | Adamson | 114/230 |
| 4,193,368 | 3/1980 | DeGraff | 114/230 |

*Primary Examiner*—Trygve M. Blix
*Assistant Examiner*—D. W. Keen
*Attorney, Agent, or Firm*—Freilich, Hornbaker, Wasserman, Rosen & Fernandez

[57] ABSTRACT

A single leg mooring terminal is described, of the type which includes a buoy assembly extending from the sea floor to the sea surface to moor a tanker vessel, and a separate fluid conduit extending at an upward incline to the vessel for carrying oil to or from it, and wherein the buoy assembly includes a tilt joint and both the buoy assembly and hose structure must rotate without limit about the same vertical axis to follow drifting of the vessel about the installation. The vertical rotation joint which joins the rotatable upper portion of the buoy assembly to the stationary lower portion thereof, is located below the tilt joint, and a fluid swivel of the conduit is joined to a sidewardly-extending pipe which extends sidewardly at a level above the vertical rotation joint but below the top of the tilt joint.

1 Claim, 9 Drawing Figures

FIG. 1
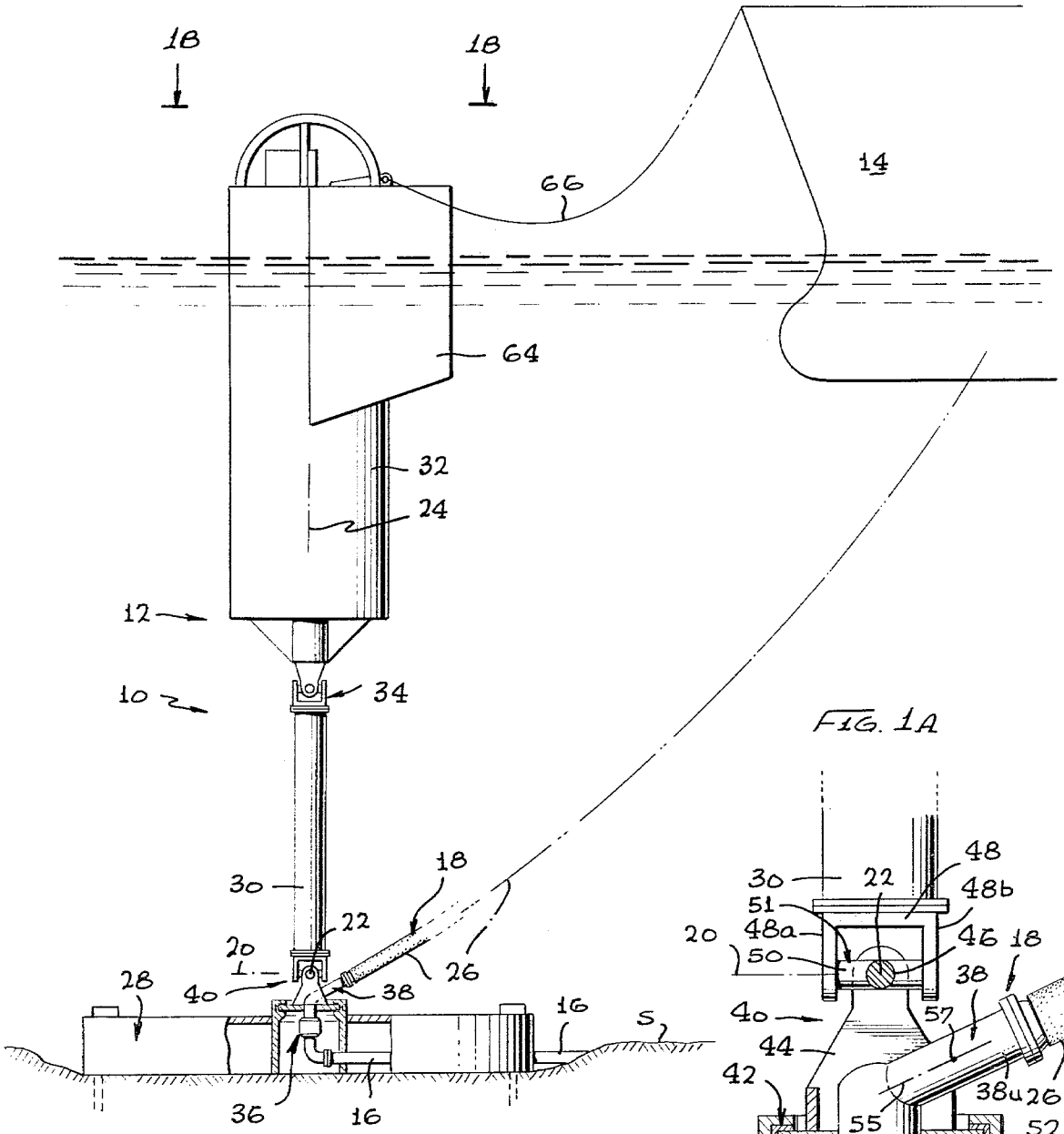
FIG. 1A
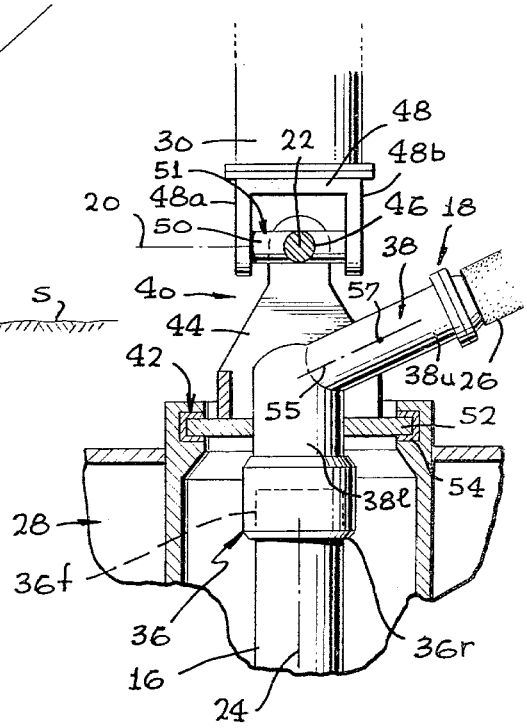
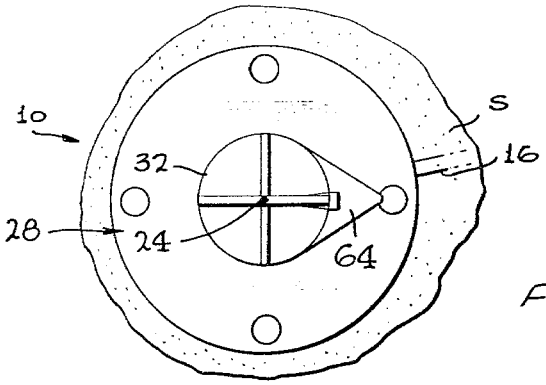
FIG. 1B

FIG. 4
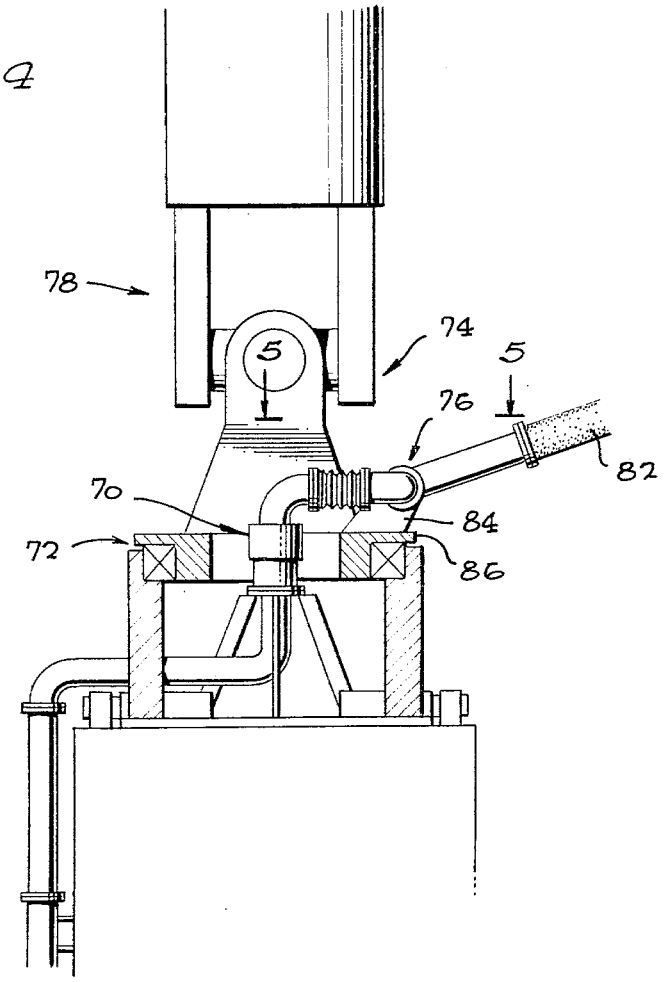
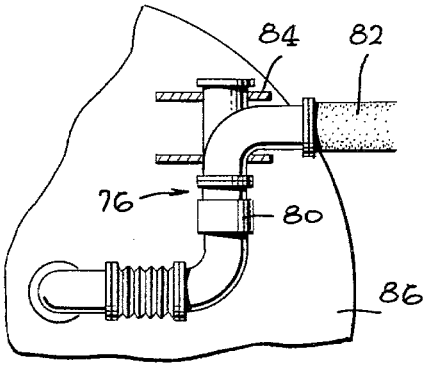
FIG. 5

FIG. 7
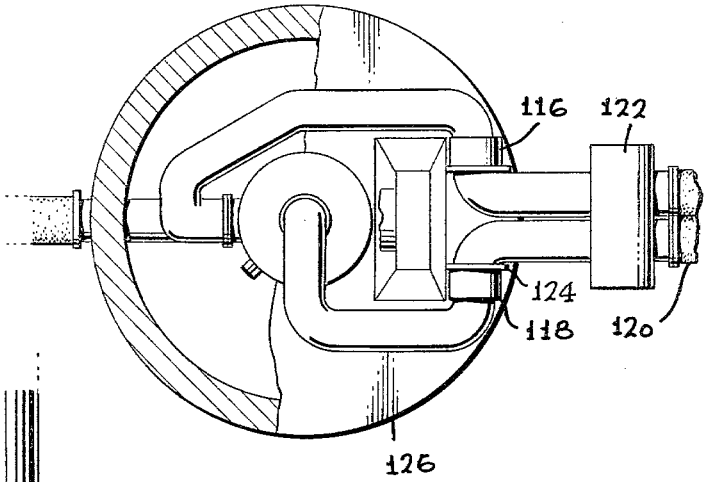
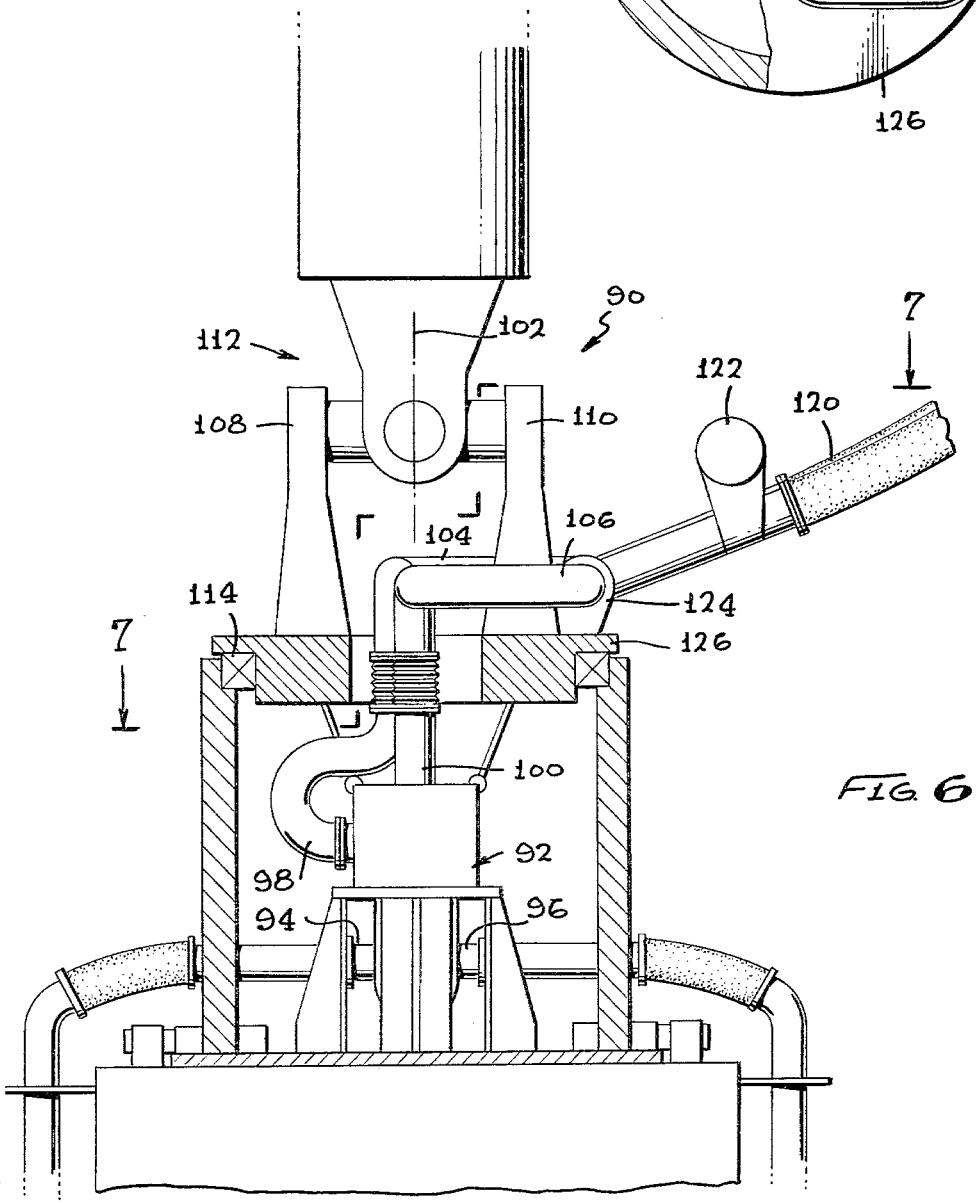
FIG. 6

SINGLE LEG MOORING TERMINAL

BACKGROUND OF THE INVENTION

One type of offshore installation utilized to moor a tanker and connect a hose to it, includes a buoy assembly extending from the seabed to the sea surface and with its upper end tied by a hawser to the vessel, and a floating hose structure which extends at an upward incline from the seabed to the surface independently of the buoy assembly. The buoy assembly includes at least one tilt joint which allows it to tilt to follow limited movement of the vessel towards and away from the center of the installation. Both the buoy assembly and hose structure require joints that permit unlimited rotation about a substantially vertical axis, to follow drifting of the vessel about the center of the installation.

One common approach to permit rotation of the buoy assembly and hose structure about the same vertical axis, is to utilize an annular fluid swivel with a large hole in the center through which the buoy assembly extends. This permits the upward mooring load to be transmitted to the seabed without being transmitted directly through the fluid swivel. One disadvantage of this arrangement is that the annular fluid swivel cannot be removed without detaching the buoy assembly from the seabed. In addition, an annular fluid swivel is substantially more complex than a fluid swivel that does not require a hole along its axis of rotation.

One type of mooring installation that facilitates replacement of the fluid swivel while permitting a simple swivel to be utilized, positions the fluid swivel along the vertical axis of rotation, in a hollow portion of the buoy assembly. The buoy assembly has a side opening through which a pipe from the rotatable portion of the fluid swivel can pass sidewardly away from the buoy assembly. British Pat. No. 1,524,906 shows a few installations of this type, wherein the fluid swivel is located on the upper rotating part of the buoy installation where an opening can be provided for the sidewardly extending pipe. However, these designs involve the use of fluid-carrying tilt joints, such as flexible hoses, immediately below the fluid swivel, to carry fluid across a tilt joint of the buoy assembly. Such fluid tilt joints that are subjected to repeated tilting, are liable to breakdown and increase the maintenance requirements for the installation, as where a short section of a flexible hose is used which undergoes repreated considerable bending. A mooring installation of the type which has a hose structure extending to the vessel independently of much of the buoy assembly, which enabled a simple and easily accessed fluid swivel to be utilized without requiring the use of high maintenance underwater parts, would facilitate the construction and operation of mooring and cargo transfer installations.

SUMMARY OF THE INVENTION

In accordance with one embodiment of the present invention, a mooring installation is provided of the type that includes a tiltable and rotatable riser and buoy assembly for mooring a vessel and that also includes a separate fluid conduit that can rotate with the buoy assembly and vessel, which enables a simple, compact, and easily maintainable fluid swivel to be utilized while avoiding high maintenance parts. The vertical rotation joint which enables the upper portion of the buoy assembly to rotate about a vertical axis, is located immediately below the tilt joint which permits the buoy assembly to tilt. The fluid conduit includes a fluid swivel that lies along the axis of the vertical rotation joint, and a rotating pipe that extends sidewardly from the fluid swivel and sidewardly through a space left between the vertical rotation joint and the tilt joint. The tilt joint can include lower and upper yokes that permit tilting about two perpendicular axes, and the pipe extending sidewardly from the fluid swivel can extend through the space left between a pair of arms of the lowermost yoke.

The novel features of the invention are set forth with particularly in the appended claims. The invention will be best understood from the following description when read in conjunction with the accompanying drawings.

BRIEF DESCRIPTION OF THE DRAWINGS

FIG. 1 is a side elevation view of a single leg mooring installation constructed in accordance with the present invention.

FIG. 1A is a side elevation view of a portion of the installation of FIG. 1.

FIG. 1B is a view taken on the line 1B—1B of FIG. 1.

FIG. 4 is a sectional view of a portion of the installation of FIG. 3.

FIG. 5 is a view taken on the line 5—5 of FIG. 4.

FIG. 6 is a partial sectional view of a mooring installation constructed in accordance with another embodiment of the invention, for a multiproduct fluid transfer.

FIG. 7 is a view taken on the line 7—7 of FIG. 6.

DESCRIPTION OF THE PREFERRED EMBODIMENTS

Figure 2:
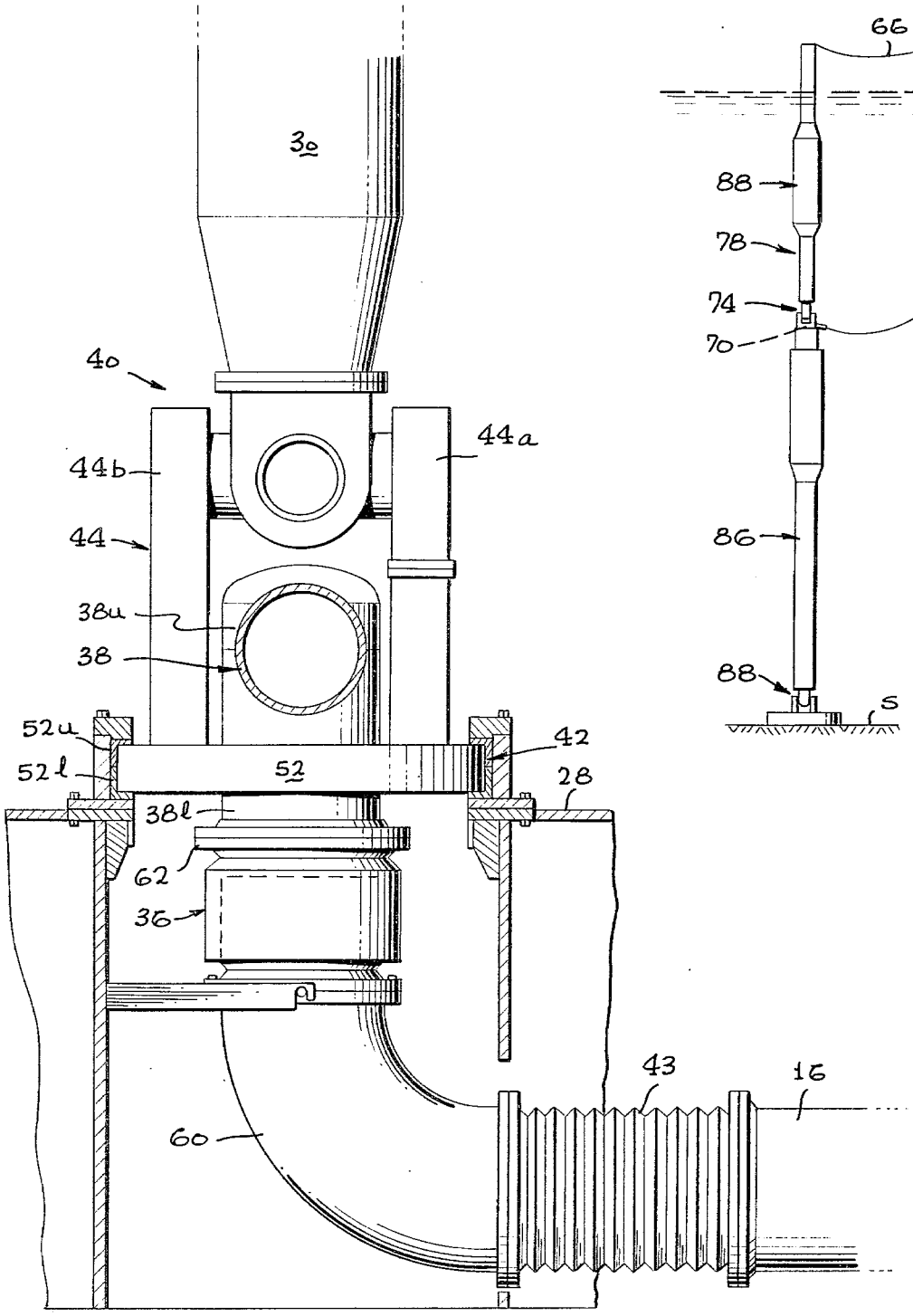
FIG. 2 is a partial sectional view of the installation of FIG. 1 but with the upper portion of the buoy assembly rotated 90° from the position shown in FIGS. 1 and 1A.

FIG. 1 illustrates a single leg mooring installation 10 which is installed on a seabed S, and which includes a riser and buoy assembly 12 that can moor a tanker vessel 14 while oil or gas is transferred from a seabed pipeline 16 through a fluid conduit 18 to the vessel. The buoy assembly 12 is designed so that it can tilt about horizontal axes such as 20 and 22 to resiliently anchor the vessel, and so that its upper portion can rotate without limit about a substantially vertical axis 24, to follow drifting of the vessel about the installation. The conduit 18 includes a hose structure 26 which is flexible along most of its length and that extends sidewardly from the buoy assembly 12, to extend independently of it up to the vessel. The hose structure 26 must also rotate without limit about the vertical axis 24 together with the buoy assembly to follow drifting of the vessel.

The riser and buoy assembly 12 includes a non-rotatable base 28 at the seabed, a riser 30 extending upwardly from the base, and a buoy 32 connected to the top of the riser by an upper tilt joint 34. As also shown in FIGS. 1A and 2, the conduit 18 includes a fluid swivel 36 lying on the vertical axis 24, and having a fixed portion **36*f* substantially fixed to the pipeline 16 and a rotatable portion 36*r*. The rotatable portion 36*r* of the fluid swivel connects to conduit portion formed by a pipe 38 that has a part angled to extend away from the axis 24 in a partially sideward direction and to connect to the hose structure 26**.

The bottom of the riser 30 is connected to the base 28 by a tilt joint 40 that permits tilting of the riser and buoy about the horizontal axes 20, 22 and also by a vertical rotation joint 42 that permits the riser and buoy to rotate about the vertical axis 24. It may be noted that a chain type riser can be used to hold the buoy. The tilt joint 40 includes a lower part in the form of a yoke 44 having a pair of upstanding arms 44*a*, 44*b*, and carrying a shaft 46. The tilt joint also includes an upper part in the form of a yoke 48 having a pair of arms 48*a*, 48*b* that carry another shaft 50. The two shafts 46, 50 are fixed together and form an intermediate part 51 pivotally jointed to the upper and lower parts of the tilt joint. The vertical rotation joint 42 includes a wide platform 52 which is rotatably mounted on bearings 54 about the vertical axis 24.

In accordance with the present invention, the vertical rotation joint 42 is located below the tilt joint 40, with the vertical rotation bearing 54 lying below the horizontal axes of pivoting at 20 and 22. In addition, the pipe 38 whose lower radially-inner end 38*l* extends vertically and whose upper radially outer end 38*u* extends with a large horizontal directional component, is located so that its sidewardly-extending upper end portion 38*u* lies above the vertical rotation joint 42 but below the top of the tilt joint 40. It can be seen that the axis 55 of the upper pipe portion, crosses the adjacent radially outer portion of the lower yoke at 57, which is located above the vertical rotation bearing 54 but below the tilt axes 20 and 22. It may be noted that the tilt joint 40 should be located only a small distance above the vertical rotation joint, to minimize the tilting or overturning moment on the vertical rotation joint. As a result of the sidewardly-extending pipe portion 38*u* lying above the bottom of the vertical rotation joint but below the top of the tilt joint, only a simple fluid swivel 36 is required to accommodate the rotational movement of the upper pipe end 38*u* about the vertical axis. That is, the upper pipe end 38*u* does not have to undergo tilting movement to which the riser 30 is subjected. In addition, the upper end 38*u* of the pipe can rotate without limit about the vertical axis 24 together with rotation of the riser 30 and the buoy connected to it, to follow drifting of the ship. This is accomplished in a manner that permits relatively easy access to the fluid swivel 36, in that it can be removed without requiring the riser 30 to be detached from the base 28.

As shown in FIG. 2, which shows greater details of the installation, and which shows the pivot joint 40 after it has been rotated 90° from the orientation of FIG. 1A, removal of the fluid swivel 36 can be accomplished by a diver positioned under the vertical rotation joint 42. A large hole (not shown) is provided in the base 28 to permit such access. To remove the fluid swivel, the diver first detaches and lowers the ends of a pipe section 60 lying under the fluid swivel, from the fluid swivel 36. An expansion joint 43 facilitates such pipe section movement. The fluid swivel then can be detached from a flange 62 on the pipe 38. During such replacement of the fluid swivel, the buoy can continue to be connected through the pivot and vertical rotation joints to the base 28. The pipe 38 can be separately supported on the vertical rotation platform 52, and can include a domed lower portion 38*l* and a straight pipe upper portion 38*u* which intersects the top of the lower domed portion.

The mounting of the sidewardly-extending pipe 38*u* above the vertical rotation joint 42 but below the tilt joint 40, not only avoids the need for providing a fluid-carrying tilt joint along the pipe 38 to tilt with the buoy, but also can save space and more reliably rotate the rotatable portion of the fluid conduit 18. Saving of space and lightening of the installation is enhanced by the fact that there is already a space between the two legs of the lower yoke 44, and this space is utilized to pass the sidewardly-extending pipe 38*u*, which saves on material and space even though the yoke 44 is somewhat taller than otherwise. It may be noted that the upper portions of the arms 44*a*, 44*b* can be connected together above the pipe 38. The yoke 44 or a bracket extending from the rotatable platform 52 can serve to apply the necessary torque to the pipe 38 to assure that it rotates with the buoy, with minimal strain applied to the pipe 38. It should be noted that the sidewardly-extending pipe 38*u* can be a flexible hose, although a relatively rigid pipe is preferred because of increased reliability.

The large diameter rotating platform 52, which has a diameter much greater than the vertical distance between its upper and lower bearings at 54*u*, 54*l*, provides a wide base to support the rotating arm 38 and apply torque to it to rotate it with the buoy. It is possible to use a small diameter vertical rotation joint, with the upper and lower bearings spaced at greatly different levels to withstand moderate tilting force. However, such a small diameter rotating platform cannot easily apply torque to the sidewardly-extending pipe to rotate it, without the addition of a separate cantilevered beam extending from the small platform. In one system designed as shown in FIG. 2, the rotating platform 52 had a diameter of about two meters, and the other parts were proportioned as illustrated.

It may be noted that, in order to enhance rotation of the buoy 32 with rotation or drifting of the vessel 12 around the vertical axis of the installation, a fin-like rudder 64 (FIG. 1 and 1B) is provided at the top of the buoy 32. This helps avoid the possibility of the hawser 66 that connects the buoy to the vessel wrapping around the buoy, and since the buoy assembly 12 is here utilized to also rotate the hose assembly 26, the arrangement also minimizes the possibility of wrapping of the hose structure 26 around the installation. When a floating hose is not attached to a vessel, and may drift about the installation under the influence of wind, waves and currents, the rudder 64 causes the buoy 32 to also turn and thereby avoid wrapping of the hose around the riser.

Figure 3:
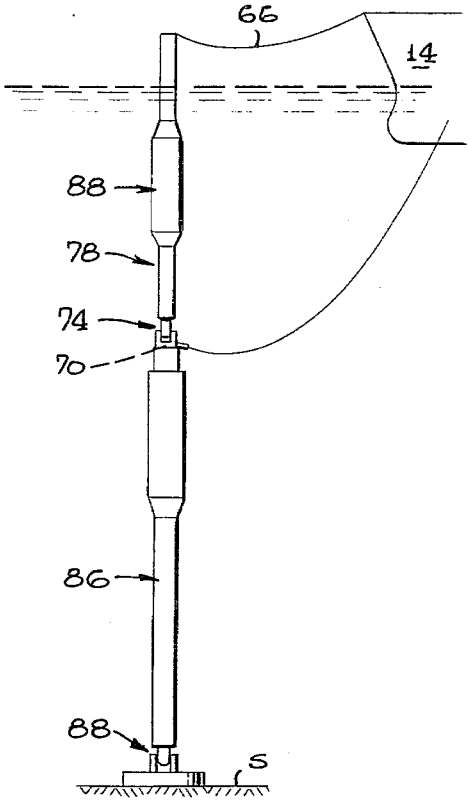
FIG. 3 is a side elevation view of a mooring installation constructed in accordance with another embodiment of the invention.

FIGS. 3–5 illustrate another mooring installation for deeper waters, wherein the swivel unit 70 lies a considerable distance above the seabed S. As in FIGS. 1–2, the vertical rotation joint 72 is located below the tilt joint 74, and a sidewardly-extending pipe structure 76 which extends to the side of the riser and buoy assembly 78, lies at a level above the vertical rotation joint 72 but below the top of the tilt joint 74. The pipe structure 76, which is part of the conduit that extends from the sea floor to the vessel, is constructed, as shown in FIG. 5, with an additional fluid swivel 80 that permits the hose structure 82 to more easily move up and down. The pipe structure is supported on a bracket 84 which is mounted on the large diameter rotatable platform 86 of the vertical rotation joint, at the radially outer portion of the platform. In the installation of FIG. 3, a lower riser 86 with a buoy at its upper end, can tilt about a lower tilt joint 88, but cannot freely rotate about a vertical axis, while an upper riser and float portion 88 can rotate as well as tilt because of the rotation and tilt joints described above.

FIGS. 6 and 7 illustrate a portion of a mooring and fluid cargo transfer system 90 which is designed to transfer two fluids. A multiproduct distribution unit or fluid swivel 92 is provided, which has two stationary fluid inputs 94, 96 and two rotational fluid outputs 98, 100 that can rotate about a vertical axis 102. Two sidewardly-extending pipes 104, 106 extend through the spaces between the two arms 108, 110 of a lower yoke of a tilt joint 112, which is located above a vertical rotation joint 114. Two additional fluid swivel units 116, 118 (FIG. 7) are provided to facilitate up and down movement of the hose structure 120, and a buoyancy tank 122 is provided to counteract the weight of the pipes. Bracket 124 support the fluid swivels on the radially outer portion of a rotatable platform 126.

Thus, the invention provides a replaceable fluid swivel installation for a mooring and cargo transfer system, which avoids the need for a fluid tilt joint near the swivel unit. This is accomplished by positioning the sidewardly-extending pipe structure that extends from the rotatable portion of the swivel unit, so that it lies at a level above the vertical rotation joint, or at least the bottom thereof, and below the top of the tilt joint of the buoy assembly. Where a double yoke tilt joint as utilized to enable tilting of the buoy with respect to the base or other lower portion of the buoy assembly, the sidewardly-extending pipe structure can pass through the space between the pair of upstanding legs of the lower yoke. The vertical rotation joint can utilize a large diameter rotating platform, and the pipe structure can be supported on the radially outer portion of the platform.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. In a single leg mooring installation which includes a riser and buoy assembly extending up from the sea floor to near the sea surface to moor to a vessel, and a fluid conduit which can extend upwardly from the sea floor and sidewardly from an underwater location to the vessel to transfer a fluid cargo between a pipe near the sea floor and the vessel, and wherein the upper portion of the buoy assembly must be tiltable and the upper portions of both the buoy assembly and fluid conduit must be capable of rotating without limit about a substantially vertical axis to follow a drifting vessel, the improvement wherein;

said buoy assembly includes a lower nonrotatable portion, which is substantially nonrotatable about a vertical axis, an upper rotatable portion, and a vertical rotation joint disposed between them, and said buoy assembly also includes a tilt joint;

said fluid conduit includes a fluid swivel with its axis located substantially coaxial with the axis of said vertical rotation joint;

said vertical rotation joint is located below the tilt joint, said fluid swivel is located below the top of said tilt joint, and said conduit includes a sidewardly-extending portion extending from the rotatable portion of the fluid swivel and to the side of the buoy assembly at a level between the bottom of the vertical rotation joint and the top of the tilt joint; and said vertical rotation joint includes a wide platform and a bearing assembly rotatably supporting said platform on said nonrotatable portion of said buoy assembly, the diameter of said platform being greater than the vertical height of said bearing assembly; and including pipe support means connected to said sidewardly-extending portion of said conduit and to the radially outer portion of said platform.

* * * * *